United States Patent [19]

Inoue et al.

[11] Patent Number: 4,777,113

[45] Date of Patent: Oct. 11, 1988

[54] SILVER HALIDE PHOTOGRAPHIC MATERIAL CONTAINING A SILICA CONTAINING OVERLAYER AND SPECIFIC HYDRAZINE DERIVATIVES

[75] Inventors: Nobuaki Inoue; Senzo Sasaoka; Tomoo Murakami, all of Kanagawa, Japan

[73] Assignee: Fuji Photo Film Co., Ltd., Kanagawa, Japan

[21] Appl. No.: 56,311

[22] Filed: May 28, 1987

Related U.S. Application Data

[63] Continuation of Ser. No. 807,079, Dec. 10, 1985, abandoned.

[30] Foreign Application Priority Data

Dec. 12, 1984 [JP] Japan ..... 59-262278

[51] Int. Cl.[4] ..... G03C 1/06; G03C 1/76

[52] U.S. Cl. ..... 430/264; 430/523; 430/537; 430/599; 430/950; 430/961

[58] Field of Search ..... 430/264, 537, 599, 950, 430/961, 523

[56] References Cited

U.S. PATENT DOCUMENTS

| | | | |
|---|---|---|---|
| 3,053,662 | 9/1962 | Mackey | 96/87 |
| 3,161,519 | 12/1964 | Alsup | 96/85 |
| 3,591,379 | 7/1971 | Plakunov | 96/50 |
| 3,620,728 | 11/1971 | Cottingham | 96/29 |
| 3,874,878 | 4/1975 | Rasch | 96/87 |
| 3,895,950 | 6/1975 | Geiger | 96/87 |
| 3,920,456 | 11/1975 | Nittel | 96/87 |
| 4,069,053 | 1/1978 | Mayama | 96/87 |
| 4,190,449 | 2/1980 | Naoi et al. | 430/961 |
| 4,221,857 | 9/1980 | Okutsu et al. | 430/599 |
| 4,224,401 | 9/1980 | Takada | 430/437 |
| 4,235,959 | 11/1980 | Thijs et al. | 430/961 |
| 4,264,719 | 4/1981 | Kameoka et al. | 430/961 |
| 4,499,179 | 2/1985 | Ota et al. | 430/961 |
| 4,508,818 | 4/1985 | Ogawa et al. | 430/951 |

*Primary Examiner*—Jack P. Brammer

*Attorney, Agent, or Firm*—Sughrue, Mion, Zinn, Macpeak & Seas

[57] ABSTRACT

A negative silver halide photographic material comprising a support having provided thereon at least one light-sensitive silver halide emulsion layer and further provided on the light-sensitive halide layer at least two light-insensitive hydrophilic colloidal layers, the uppermost layer of the light-insensitive hydrophilic colloidal layers containing colloidal silica and the emulsion layer or other hydrophilic colloidal layer containing a hydrazine derivative. The material exhibits super-high contrast and is less susceptible to scratch fog.

13 Claims, No Drawings

SILVER HALIDE PHOTOGRAPHIC MATERIAL CONTAINING A SILICA CONTAINING OVERLAYER AND SPECIFIC HYDRAZINE DERIVATIVES

This is a continuation of application Ser. No. 06/807,079, filed Dec. 10, 1985, now abandoned.

FIELD OF THE INVENTION

This invention relates to a silver halide photographic material having improved film properties. More particularly, this invention relates to a negative super-high contrast silver halide photographic material having reduced scratch fog due to contact with a camera or a processing machine in a photomechanical process.

BACKGROUND OF THE INVENTION

In the field of graphic arts, an image formation system that provides a super-high contrast, particularly, a gamma of 10 or more is required in order to achieve satisfactory reproduction of a continuous tone image by dot formation or a line image.

For this purpose, a special developer called lith developer has conventionally been employed. A lith developer comprises hydroquinone as a sole developing agent and contains, as a preservative, a sulfite in the form of an adduct with formaldehyde having an extremely reduced free sulfite ion concentration, usually 0.1 mol/l or less, so as not to hinder infectious developability. The lith developer has the serious disadvantage that it does not withstand storage for more than 3 days because of its great susceptibility to aid oxidation.

Methods for obtaining high contrast characteristics with a stable developer include a method of using hydrazine derivatives as disclosed in U.S. Pat. Nos. 4,224,401, 4,168,977, 4,166,742, 4,311,781, 4,272,606, 4,211,857 and 4,243,739. According to this method, photographic characteristics of super-high contrast and high sensitivity can be obtained. In addition, since a sulfite can be added to a developer in high concentrations, the developer shows greatly improved stability against air oxidation when compared with the lith developer.

On the other hand, silver halide photographic materials have recently been produced with a remarkably increased speed in coating, drying and finishing steps as compared with conventional production processes. There is a tendency for these materials to be handled under severe conditions with developments in miniaturization of cameras, automatic carrying systems and the like. Accordingly, prevention of fog of silver halide emulsions which is induced by pressure is increasingly important.

Although the above-described high-contrast light-sensitive systems using hydrazine derivatives achieve remarkably increased sensitivity and contrast, the materials used are particularly sensitive to pressure causing scratch fog, especially pressure marks, resulting in significant impairment in photographic quality.

While great efforts have been made to overcome the problem of scratch fog, such as, for example, increasing the film thickness of a protective layer, such a process involves disadvantages such as retardation of development and the like. It has proved difficult to prevent scratch fog while retaining the effects of the above-described hydrazine derivatives in increasing sensitivity and contrast.

SUMMARY OF THE INVENTION

Accordingly, an object of this invention is to provide a silver halide photographic material which has photographic characteristics of super-high contrast and reduced pressure marks.

It has now been found that the above object can be achieved by a negative silver halide photographic material comprising a support having provided thereon at least one light-sensitive silver halide emulsion layer and further provided on the light-sensitive silver halide emulsion layer at least two light-insensitive hydrophilic colloidal layers, wherein the uppermost layer of the light-insensitive hydrophilic colloidal layers contains colloidal silica and the emulsion layer or other hydrophilic colloidal layer contains a hydrazine derivative.

The novel feature of this invention is a plurality of, especially two, protective layers, the uppermost layer of which contains colloidal silica. Such a protective layer structure is extremely excellent in reducing scratch fog without a sacrifice of sensitivity and contrast as compared with a layer structure having only one protective layer containing colloidal silica or a layer structure having two or more protective layers wherein a layer beneath the uppermost layer contains colloidal silica.

DETAILED DESCRIPTION OF THE INVENTION

Colloidal silica which can be used in the present invention preferably has an average particle size of from about 7 to 120 mμ, more preferably from about 8 to 80 mμ, and more preferably from about 10 to 50 mμ. It mainly comprises silicon dioxide and may contain, as minor components, alumina, sodium aluminate, etc. Further, the colloidal silica may contain, as stabilizers, inorganic bases, e.g., sodium hydroxide, potassium hydroxide, lithium hydroxide, ammonium hydroxide, etc., or organic salts, e.g., tetramethylammonium salts. In particular, colloidal silica containing potassium hydroxide or ammonium hydroxide as a stabilizer is preferred.

These colloidal silicas are described, e.g., in Egon Matijevic (ed.), *Surface and Colloid Science,* Vol. 6, pages 3 to 100 (John Wiley & Sons, 1973).

Specific examples of the colloidal silica usable in the present invention include commercially available products, such as Snowtex 20, Snowtex C, Snowtex N, Snowtex O, trade names manufactured by Nissan Chemicals Ind., Ltd.; Ludox AM, Ludox AS, Ludox LS, Ludox TM, Ludox HS, trade names manufactured by E. I. Du Pont de Nemours & Co.; Syton C-30, Syton 200, trade names manufactured by Monsanto Co.; Nalcoag 1030, Nalcoag 1060, Nalcoag ID-21-64, trade names manufactured by Nalco Chem. Co.; and similar commercially available colloidal silicas.

The amount of the colloidal silica to be used in the present invention is not particularly limited, but, it preferably ranges from about 10 to 50% and more preferably from about 20 to 40% based on the weight of a hydrophilic colloid in the uppermost layer in which the colloidal silica is to be incorporated, or the coverage of the colloidal silica to be used preferably ranges from about 0.05 to 0.5 $g/m^2$ and more preferably from about 0.07 to 0.3 $g/m^2$. Furthermore, it is particularly preferred when the colloidal silica is preferably present in an amount of from about 10 to 50% and more preferably from about 20 to 40% based on the hydrophilic colloid in the uppermost layer, and is preferably coated in an amount of from about 0.05 to 0.5 g/m$^2$ and more preferably from about 0.07 to 0.3 g/m$^2$.

In the present invention, a total thickness of the two or more light-insensitive colloidal layers (protective layers) is not particularly restricted, but preferably falls within a range of from about 0.3 to 5 μm, more preferably from about 0.5 to 2 μm, and most preferably from about 0.7 to 1.5 μm. The protective layer structure preferably comprises two layers. In this case, a preferred ratio of the thickness of the upper layer to that of the lower layer is about 1.0 or smaller.

The hydrophilic colloid which can be used as a binder in the protective layers is preferably gelatin. However, other hydrophilic colloids may also be employed.

Examples of usable hydrophilic colloids other than gelatin include proteins, e.g., gelatin derivatives, graft polymers of gelatin with other high polymers, albumin and casein; cellulose derivatives, e.g., hydroxyethyl cellulose, carboxymethyl cellulose and cellulose sulfate; sugar derivatives, e.g., sodium alginate and starch derivatives; and a wide variety of synthetic hydrophilic high polymers, such as homopolymers, e.g., polyvinyl alcohol, polyvinyl alcohol partial acetal, poly-N-vinylpyrrolidone, polyacrylic acid, polymethacrylic acid, polyacrylamide, polyvinylimidazole and polyvinylpyrazole, and copolymers comprising the monomer units constituting these homopolymers.

The gelatin which can be used includes not only lime-processed gelatin but also acid-processed gelatin as well as enzyme-processed gelatin as described in *Bull. Soc. Sci. Photo. Japan,* No. 16, page 30 (1966). Hydrolysis products and enzymatic decomposition products of gelatin may also be used.

The protective layers according to the present invention can contain, if desired, matting agents, e.g., fine particles of polymethyl methacrylate, thickeners, e.g., potassium polystyrenesulfonate, hardeners, surface active agents, slip agents, ultraviolet absorbents, and the like. The lower protective layer or layers other than uppermost protective layer can further contain a dispersion of a water-insoluble or sparingly water-soluble polymer, including those comprising monomer units selected from alkyl (meth)acrylates, alkoxyalkyl(meth-)acrylates, glycidyl(meth)acrylates, (meth)acrylamides, vinyl esters (e.g., vinyl acetate), acrylonitrile, olefins and styrene, and combinations thereof, or combinations of these monomer units with acrylic acid, methacrylic acid, α,β-unsaturated dicarboxylic acids, hydroxyalkyl(meth)acrylates, sulfoalkyl(meth)acrylates and styrenesulfonic acids.

The hydrazine derivatives which can be used in the present invention include compounds represented by the following formula (I) and the compounds disclosed in U.S. Pat. No. 4,478,928:

$$R_1\text{—NHNH—CHO} \qquad \text{(I)}$$

wherein $R_1$ represents an aliphatic group or an aromatic group.

In the above-described formula (I), the aliphatic group represented by $R_1$ is a straight or branched chain or cyclic alkyl group having from about 1 to 30, and preferably from about 1 to 20 carbon atoms. The aliphatic group may be a saturated hetero ring containing one or more hetero atoms. The alkyl group may have a substituent, such as an aryl group, an alkoxy group, a sulfoxy group, a sulfonamido group, a carbonamido group. Specific examples of the aliphatic group for $R_1$ are t-butyl, n-octyl, t-octyl, cyclohexyl, pyrrolidyl, tetrahydrofuryl and morpholino groups.

The aromatic group as represented by $R_1$ is a mono- or bicyclic aryl group or an unsaturated heterocyclic group. The unsaturated heterocyclic group may be condensed with a mono- or bicyclic aryl group to form a heteroaryl group. Specific examples of the aromatic group for $R_1$ are benzene, naphthalene, pyridine, pyrimidine, imidazole, pyrazole, quinoline, isoquinoline, benzimidazole, thiazole and benzothiazole ring, with those containing a benzene ring being particularly preferred.

Among the above-described groups, $R_1$ is preferably an aryl group.

The aryl group and other aromatic groups may be substituted with, for example, a straight or branched chain or cyclic alkyl group (preferably having from about 1 to 20 carbon atoms), an aralkyl group (mono- or bicyclic; the alkyl moiety preferably containing from 1 to 3 carbon atoms), an alkoxy group (preferably having from about 1 to 20 carbon atoms), a substituted amino group (preferably substituted with an alkyl group having from about 1 to 20 carbon atoms), an acylamino group (preferably having from about 2 to 30 carbon atoms), a sulfonamido group (preferably having from about 1 to 30 carbon atoms), or a ureido group (preferably having from about 1 to 30 carbon atoms).

The group $R_1$ in the above formula (I) may contain a ballast group commonly employed in immobile photographic additives, such as couplers. The ballast group contains 8 or more carbon atoms and is photographically relatively inert. Examples of such a ballast group include an alkyl group, an alkoxy group, a phenyl group, an alkylphenyl group, a phenoxy group, an alkylphenoxy group, and the like.

The group $R_1$ may further contain a group that enhances adsorption of the compound (I) onto silver halide grains. Such an adsorption group includes those described in U.S. Pat. No. 4,385,108, e.g., a thiourea group, a heterocyclic thioamido group, a mercapto heterocyclic group, a triazole ring.

The compounds of the formula (I) can be synthesized by the methods described in Japanese Patent Application (OPI) Nos. 20921/78 (corresponding to U.S. Pat. No. 4,168,977), 20922/78 (corresponding to U.S. Pat. No. 4,224,401), 66732/78 (corresponding to U.S. Pat. No. 4,224,401) and 20318/78 (corresponding to U.S. Pat. No. 4,031,127, (the term "OPI" as used herein refers to an "unexamined published Japanese patent application").

The compounds of the formula (I) according to the present invention are preferably incorporated in a silver halide emulsion layer, but may also be incorporated in another light-insensitive hydrophilic colloidal layer, such as a protective layer, an intermediate layer, a filter layer, an antihalation layer, and the like. Incorporation of the compound (I) into a light-sensitive material can be carried out by dissolving the compound (I) in water or a water-miscible organic solvent, e.g., alcohols, esters, ketones, etc., according to its water solubility and adding the solution to a hydrophilic colloid solution. In the case of incorporation in a silver halide emulsion layer, the incorporation may be effected at any stage from the start of chemical ripening through the time immediately before coating, preferably from the time after completion of the chemical ripening through the time immediately before coating. Particularly, the compound (I) is preferably incorporated into a coating solution prepared for coating.

The amount of the compound of the formula (I) to be added is desirably selected depending on the grain size and halogen composition of silver halide grains, the method and degree of chemical sensitization, the relation between the layer in which the compound (I) is to be contained and a silver halide emulsion layer, the kind of an antifoggant, and the like. The preliminary test method for such selection is well known to one skilled in the art. Usually, the amount of the compound (I) to be added falls within a range of from about $10^{-6}$ to $1\times10^{-1}$ mol, and preferably from about $10^{-5}$ to $4\times10^{-2}$ mol, per mol of silver halide.

Specific examples of the compounds of the formula (I) according to the present invention are shown below for illustrative purposes only, and are not to be construed as limiting the present invention in any way.

I-1

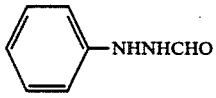

I-2

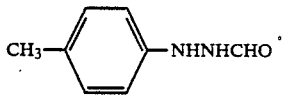

I-3

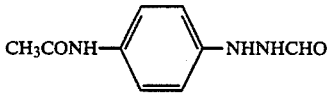

I-4

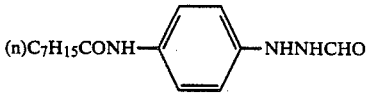

I-5

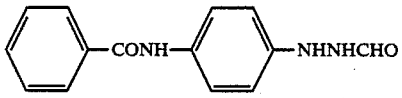

I-6

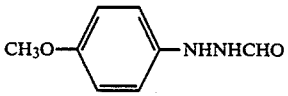

I-7

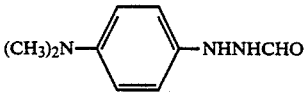

I-8

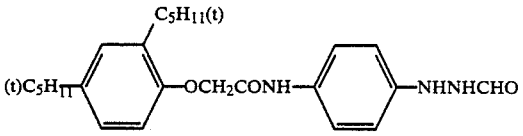

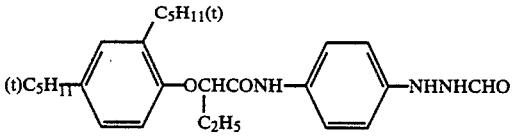

I-9

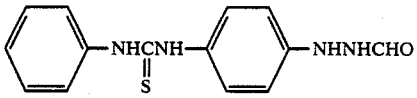

I-10

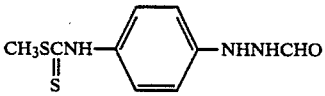

I-11

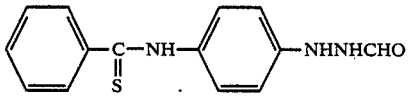

I-12

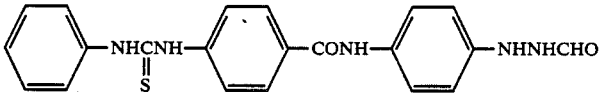

I-13

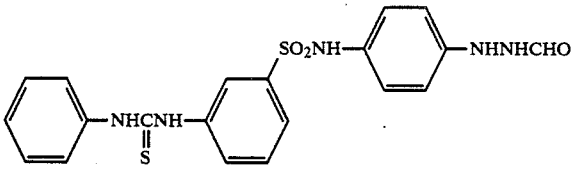

I-14

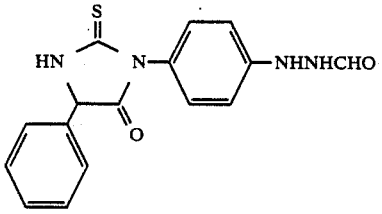

I-15

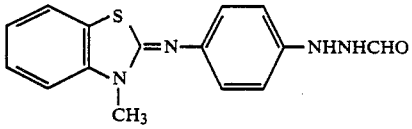

I-16

-continued
I-17
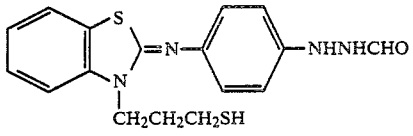
I-18
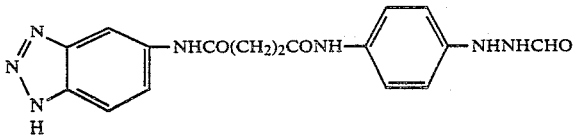
I-19
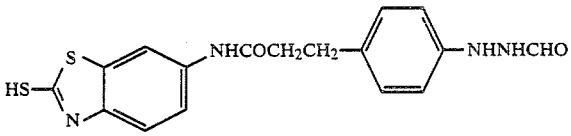
I-20
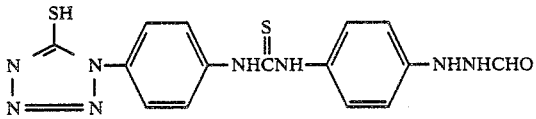
I-21
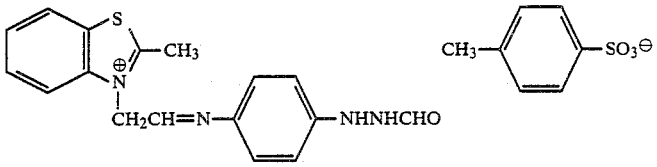
I-22
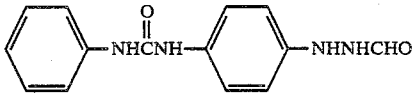
I-23
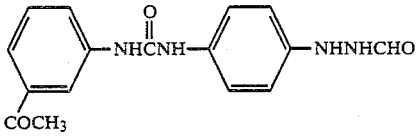
I-24
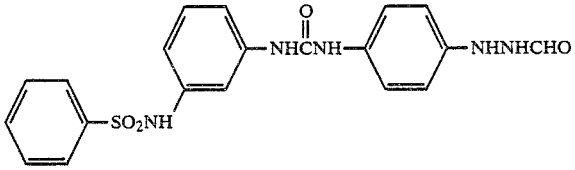
I-25
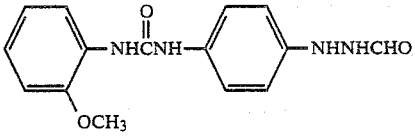
I-26
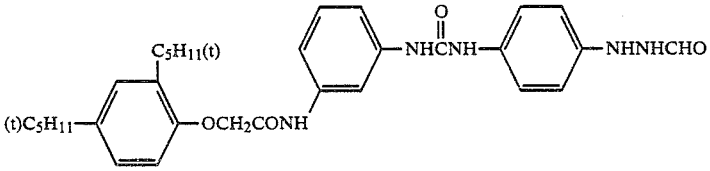
I-27
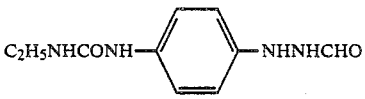
I-28
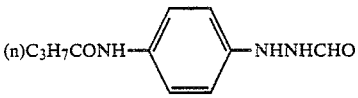

-continued

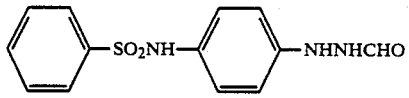

I-29

Typical examples of the hydrazine derivatives disclosed in U.S. Pat. No. 4,478,928 are as follows:

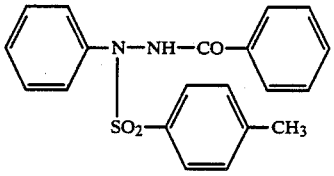

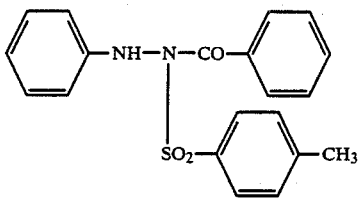

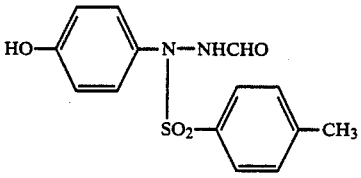

Silver halides which can be used in the present invention have conventional compositions, such as silver chloride, silver chlorobromide, silver iodobromide or silver iodochlorobromide, and are preferably compositions containing not less than about 70 mol%, and more preferably not less than about 90 mol%, of silver bromide and not more than about 10 mol%, and more preferably from about 0.1 to 5 mol%, of silver iodide.

The silver halide grains which can be used in the present invention are preferably fine grains having a mean grain size of, for example, not more than about 0.7 μm, and more preferably not more than about 0.5 μm. Grain size distribution is basically unlimited, but a mono-dispersed emulsion is preferred. The term "mono-dispersed emulsion" used herein means a silver halide emulsion wherein at least about 95% of the weight or number of total silver halide grains is included in a size range within about ±40% of the mean grain size.

The silver halide grains in the photographic emulsion may have a regular crystal form, such as a cube and an octahedron, an irregular crystal form, such as a sphere and a plate, or a composite form thereof.

The individual silver halide grains may comprise a homogeneous phase from the surface to the interior or they may comprise a core and an outer shell. Two or more silver halide emulsions separately prepared may be used as a mixture.

In a process of silver halide grain formation or of physical ripening, cadmium salts, sulfites, lead salts, thallium salts, rhodium salts or complexes thereof, and iridium salts or complexes thereof may be present.

Silver halides that are particularly suitable in the present invention are silver haloiodides having a silver iodide content on the surfaces thereof greater than the average silver iodide content which are produced in the presence of about $10^{-8}$ to $10^{-5}$ mols of an iridium salt or a complex salt thereof per mol of silver. By using an emulsion containing such a silver haloiodide, photographic characteristics of further increased sensitivity and gamma can be attained. In this case, it is desirable to add the iridium salt or complex salt thereof of the above-recited amount before completion of physical ripening, particularly at the time of grain formation.

The iridium salts or complex salts thereof that can be used are water-soluble and include, for example, iridium trichloride, iridium tetrachloride, tripotassium iridium (III) hexachloride, tripotassium iridium (IV) hexachloride and triammonium iridium (III) hexachloride.

The term "surface of grains" as above used means a surface layer to a depth of from about 100 Å to 200 Å from the surface. Silver haloiodide grains particularly preferred in the present invention are those having a silver iodide content on the surfaces thereof as thus defined at least about 50% greater than the silver iodide content averaged throughout the grains.

The silver iodide content on the surface of silver haloiodide grains can be determined by means of an X-ray photoelectron spectrometer (XPS), and the average silver iodide content throughout the grains can be determined by means of an XPS after annealing the grains at 300° C. for 3 hours to make silver iodide distribution uniform.

The silver haloiodide emulsion having the above-described specific distribution of silver iodide content within the individual grains can be produced by conventional methods, such as a conversion method as described, e.g., in U.S. Pat. Nos. 2,592,250 and 4,075,020 and Japanese Patent Application (OPI) No. 127549/80 (corresponding to British Pat. No. 2,044,944); and a method for preparing a core-shell emulsions as described, e.g., in British Pat. No. 1,027,146. In more detail, the conversion method comprises simultaneously adding a silver nitrate aqueous solution and a potassium bromide aqueous solution to a gelatin solution kept at a given temperature while maintaining a pAg value of the liquid phase wherein silver halides are to be precipitated constant to thereby prepare silver bromide and then adding a potassium iodide aqueous solution to the liquid phase to convert the surfaces of the grains. The method for preparing a core-shell structure includes a method comprising forming silver bromide grains in the same manner as described above except that the addition of the potassium iodide is replaced by simultaneous addition of a potassium bromide aqueous solution and a potassium iodide aqueous solution immediately before completion of the addition of the silver nitrate aqueous solution or addition of silver iodide fine grains at any stage from the time immediately before completion of the addition of the silver nitrate aqueous solution through the time after the addition of the silver nitrate aqueous solution, followed by Ostwald ripening, thereby forming a shell composed of silver iodide around a core composed of silver bromide. In these methods, the grain size can be varied by altering the time of adding the silver nitrate aqueous solution and potassium bromide aqueous solution and the temperature of a reaction vessel.

As binders or protective colloids for the photographic emulsions, gelatin is used to advantage, but other hydrophilic colloids may also be employed. Examples of the hydrophilic colloids include proteins, such as gelatin derivatives, graft polymers of gelatin with other high polymers, albumin or casein; cellulose derivatives, such as hydroxyethyl cellulose, carboxymethyl cellulose or cellulose sulfuric ester; sugar derivatives, such as sodium alginate or starch derivatives; and a wide variety of hydrophilic synthetic high polymers, such as homopolymers, e.g., polyvinyl alcohol, polyvinyl alcohol partial acetal, poly-N-vinylpyrrolidone, polyacrylic acid, polymethacrylic acid, polyacrylamide, polyvinylimidazole or polyvinylpyrazole, and copolymers comprising monomer units constituting these homopolymers.

The gelatin that can be used includes not only lime-processed gelatin but acid-processed gelatin. Hydrolysis products and enzymatic decomposition products of gelatin may also be used.

After the formation of silver halide grains or after physical ripening, soluble salts are usually removed from the silver halide emulsion by the conventionally known noodle washing method which comprises gelling the gelatin, or using a sedimentation process (flocculation process) using an inorganic salt comprising a polyvalent anion, e.g., sodium sulfate; an anionic surface active agent, an anionic polymer, e.g., polystyrenesulfonic acid; or a gelatin derivative, e.g., aliphatic acylated gelatin, aromatic acylated gelatin or aromatic carbamoylated gelatin. The removal of soluble salts may be omitted, if desired.

The silver halide emulsions which can be used in the present invention may or may not be chemically sensitized. Chemical sensitization of silver halide emulsions can be carried out by sulfur sensitization, reduction sensitization, noble metal sensitization or a combination thereof. Details for these sensitization processes are described in P. Glafkides, *Chimie et Physique Photographique,* pages 402 to 418 (Paul Montel, 1967), V. L. Zelikman, et al., *Making and Coating Photographic Emulsion,* pages 161 to 207 (The Focal Press, 1964), and H. Frieser (ed.), *Die Grundlagen der Photographischen Prozesse mit Silberhalogeniden* (Akademische Verlagsgeselischaft, 1968).

More specifically, sulfur sensitization can be effected using compounds containing sulfur capable of reacting with active gelatin or silver ions, e.g., thiosulfates, thioureas, thiazoles and rhodanines. Specific examples of these sulfur compounds are described, e.g., in U.S. Pat. Nos. 1,574,944, 2,278,947, 2,410,689, 2,728,668, 3,501,313 and 3,656,952.

Reduction sensitization can be carried out using reduction sensitizing agents, e.g., stannous salts, amines, formamidinesulfinic acids and silane compounds. Specific examples of these reduction sensitizing agents are described, e.g., in U.S. Pat. Nos. 2,487,850, 2,518,698, 2,983,609, 2,983,610, and 2,694,637.

Noble metal sensitization typically includes gold sensitization using gold compounds, particularly gold complex salts. Complex salts of other noble metals, e.g., platinum, palladium and iridium may also be employed. Specific examples of these noble metal compounds are described, e.g., in U.S. Pat. No. 2,448,060 and British Pat. No. 618,061.

For the purpose of increasing sensitivity, the light-sensitive materials according to this invention can be contain sensitizing dyes as described in Japanese Patent Application (OPI) No. 52050/80 (corresponding to U.S. Pat. No. 4,243,739), pp. 45–53, e.g., cyanine dyes, merocyanine dyes and the like. These sensitizing dyes may be used individually or in combination. Combinations of sensitizing dyes are frequently used for the purpose of supersensitization. The emulsions can also contain materials which do not per se possess spectral sensitizing activity or do not substantially absorb visible light but which exhibit supersensitizing activity when used in combination with the sensitizing dyes.

Specific examples of useful sensitizing dyes, combinations of dyes for supersensitization and materials exhibiting supersensitizing activity are described in *Research Disclosure,* Vol. 176, 17643, page 23, Item IV-J (December, 1978).

Various compounds can be incorporated in the light-sensitive materials of this invention for the purpose of preventing fog during the preparation, preservation or photographic processing or stabilizing photographic properties. Such compounds are known as antifoggants or stabilizers and include azoles, e.g., benzothiazolium salts, nitroindazoles, chlorobenzimidazoles, bromobenzimidazoles, mercaptothiazoles, mercaptobenzothiazoles, mercaptothiadiazoles, aminotriazoles, benzothiazoles and nitrobenzotriazoles; mercaptopyrimidines; mercaptotriazines; thioketo compounds, e.g., oxazolinethione; azaindenes, e.g., triazaindenes, tetraazaindenes (particularly 4-hydroxy-substituted (1,3,3a,7)-tetraazaindenes) and pentaazaindenes; benzenethiosulfonic acid; benzenesulfinic acid; benzenesulfonic acid amide, and the like. Of these, preferred compounds are benzotriazoles, e.g., 5-methyl-benzotriazole, and nitroindazoles, e.g., 5-nitroindazole. These compounds may be added to processing solutions.

The photographic emulsion layers or other hydrophilic colloidal layers of the photographic light-sensitive materials of this invention can further contain organic or inorganic hardeners. Examples of the hardeners which can be used include chromium salts, e.g., chromium alum and chromium acetate; aldehydes, e.g., formaldehyde, glyoxal and glutaraldehyde; N-methylol compounds, e.g., dimethylolurea and methyloldimethylhydantoin; dioxane derivatives, e.g., 2,3-dihydroxydioxane; active vinyl compounds, e.g., 1,3,5-triacryloyl-hexahydro-s-triazine and 1,3-vinylsulfonyl-2-propanol; active halogen compounds, e.g., 2,4-dichloro-6-hydroxy-s-triazine; mucohalogenic acids, e.g., mucochloric acid and mucophenoxychloric acid; and mixtures thereof.

The photographic emulsion layers or other hydrophilic colloidal layers of the light-sensitive materials prepared according to the present invention can furthermore contain various surface active agents for various purposes, such as coating aids, prevention of static charges, improvement of slipperiness, improvement of emulsion and dispersion properties, prevention of adhesion, improvement of photographic characteristics (e.g., development acceleration, increase in contrast, and sensitization), and the like.

Examples of the surface active agents which can be used include nonionic surface active agents, such as saponin (steroid type), alkylene oxide derivatives (e.g., polyethylene glycol, polyethylene glycol/polypropylene glycol condensates, polyethylene glycol alkyl ethers or polyethylene glycol alkyl aryl ethers, polyethylene glycol esters, polyethylene glycol sorbitan esters, polyalkylene glycol alkylamines or amides and polyethylene oxide adducts of silcone), glycidol derivatives (e.g., alkenylsuccinic polyglycerides and alkylphenol polyglycerides), fatty acid esters of polyhydric alcohols, alkyl esters of sugars, and the like; anionic surface active agents containing acidic groups, e.g., carboxyl, sulfo, phospho, sulfuric ester, phosphoric ester and like groups, such as alkylcarboxylates, alkylsulfonates, alkylbenzenesulfonates, alkylinaphthalenesulfonates, alkylsulfates, alkylphosphates, N-acyl-N-alkyltaurines, sulfosuccinic esters, sulfoalkylpolyoxyethylene alkylphenyl ethers, polyoxyethylene alkylphosphoric esters, and the like; amphoteric surface active agents, such as amino acids, aminoalkylsulfonic acids, aminoalkyl sulfates or phosphates, alkylbetaines, amine oxides, and the like; and cationic surface active agents, such as alkylamine salts, aliphatic or aromatic quaternary ammonium salts, heterocyclic quaternary ammonium salts, e.g., pyridinium, imidazolium, and the like, aliphatic or heterocyclic phosphonium or sulfonium salts, and the like.

The surface active agents which can be used in the present invention particularly preferably are polyalkylene oxides having molecular weights of 600 or more as described in Japanese Patent Publication No. 9412/83 (corresponding to U.S. Pat. No. 4,221,857).

The silver halide photographic materials according to the present invention can provide photographic properties of super-high contrast and high sensitivity by using a stable developer without the necessity to use a conventional infectious developer or a highly alkaline developer having a pH near 13 as described in U.S. Pat. No. 2,419,975.

More specifically, the silver halide photographic materials according to the present invention can be developed with a developer containing not less than about 0.15 mol/l of a sulfite ion as a preservative and having a pH of from about 0.5 to 12.5, and preferably from about 10.5 to 12.3, to thereby obtain a sufficiently super-high contrast negative image.

Developing agents which can be used in the present invention are not particularly restricted and include, for example, dihydroxybenzenes (e.g., hydroquinone), 3-pyrazolidones (e.g., 1-phenyl-3-pyrazolidone, 4,4-dimethyl-1-phenyl-3-pyrazolidone) and aminophenols (e.g., N-methyl-p-aminophenol), either alone or in combination.

The silver halide photographic materials in accordance with the present invention are particularly suitable for development with developers containing dihydroxybenzenes as developing agents and 3-pyrazolidones or aminophenols as auxiliary developing agents. Preferably, such developers contain from about 0.05 to 0.5 mol/l of dihydroxybenzenes and not more than about 0.06 mol/l of 3-pyrazolidones or aminophenols.

It is possible to increase the rate of development and to shorten the development time by adding amines to the developer as disclosed in U.S. Pat. No. 4,269,929.

The developer may further contain conventional additives such as a pH buffer, such as a sulfite, carbonate, borate or phosphate of an alkali metal, a development restrainer or antifoggant, such as a bromide, an iodide and an organic antifoggant (preferably nitroindazoles or benzotriazoles). If desired, the developer may furthermore contain a water softener, a dissolving aid, a toning agent, a development accelerator, a surface active agent (preferably the above-described polyalkylene oxides), a defoaming agent, a hardener, a silver stain inhibitor (e.g., 2-mercaptobenzimidazolesulfonic acids), and the like.

A fixing solution having a commonly employed composition can be used in the present invention. Typical fixing agents include thiosulfates, thiocyanates and organic sulfur compounds known to have a fixing effect. The fixing solution may contain a water-soluble aluminum salt as a hardener.

Processing temperatures are usually selected from about 18° C. to 50° C.

Photographic processing is preferably carried out by means of an automatic developing machine. In the case of using an automatic developing machine to process the materials according to the invention, even if the total processing time from loading to unloading of the light-sensitive material is set within a range of from 90 seconds to 120 seconds, images having negative gradation with sufficiently super-high contrast can be obtained.

The present invention will now be illustrated in greater detail with reference to the following example, but it should be understood that the present invention is not to be construed as being limited thereto. Unless otherwise indicated, all parts, percents and ratios are by weight.

EXAMPLE 1

A silver nitrate aqueous solution, a potassium iodide aqueous solution and an potassium bromide aqueous solution were added simultaneously to a gelatin aqueous solution kept at 50° C. in the presence of tripotassium iridium (III) hexachloride over a period of 60 minutes while maintaining at a pAg of 7.5 to prepare a silver iodobromide emulsion having a mean grain size of 0.26 μm and an average silver iodide content of 2 mol%.

The resulting emulsion was washed with water by flocculation method to remove any soluble salts, and sodium thiosulfate was added thereto to effect chemical sensitization. Thereafter, a potassium iodide aqueous solution was added to the above prepared chemically sensitized silver iodobromide emulsion to convert the surfaces of grains.

To the emulsion were then added 4-hydroxy-6-methyl-1,3,3a,7-tetraazaindene, a dispersion of polyethyl acrylate, polyethylene glycol (molecular weight: 1,000), 1,3-vinylsulfonyl-2-propanol and $4.5\times10^{-3}$ mol/mol-silver of Compound I-9.

An alkylbenzene sulfonate as surface active agent was added to a gelatin aqueous solution, thereafter a polymethylmethacrylate of a matting agent were added thereto and furthermore Snowtex C was added thereto to prepare a coating solution for an upper protective layer and a lower protective layer.

The resulting emulsion was coated on a cellulose triacetate film to a silver coverage of 3.4 g/m$^2$ simultaneously with an upper protective layer and a lower protective layer having compositions shown in Table 1.

Pressure marks due to scratches were evaluated as follows. Pressure was applied onto the light-sensitive side of the unexposed light-sensitive material by a scratch hardness tester with an indenter point whose end portion having a part of sphere which radius is 0.1 mm or 1 mm. The material was then developed with a developer of the following formulation at 38° C. for 30 seconds, stopped, fixed, washed and dried; and the load that caused pressure marks was determined.

Developer Formulation:

| | |
|---|---|
| Hydroquinone | 35.0 g |
| N—Methyl-p-aminophenol hemisulfate | 0.8 g |
| Sodium hydroxide | 13.0 g |
| Potassium tertiary phosphate | 74.0 g |
| Potassium sulfite | 90.0 g |
| Disodium ethylenediaminetetraacetate | 1.0 g |
| Potassium bromide | 4.0 g |
| 5-Methylbenzotriazole | 0.6 g |
| 3-Diethylamino-1,2-propanediol | 15.0 g |
| Water to make | 1 liter (pH = 11.5) |

TABLE 1

| Sample No. | Protective Layer | Gelatin ($g/m^2$) | Snowtex C ($g/m^2$) | Fog-Causing Load (g) 0.1 mm | 1 mm | Gamma |
|---|---|---|---|---|---|---|
| 1 | upper | 0.6 | 0.1 | 40 | 160 | 15 |
| | lower | 0.6 | — | | | |
| 2 | upper | 0.6 | 0.2 | 60 | 180 | 15 |
| | lower | 0.6 | — | | | |
| 3 | upper | 0.6 | — | 20 | 40 | 16 |
| | lower | 0.6 | — | | | |
| 4 | upper | 0.6 | — | 20 | 50 | 15 |
| | lower | 0.6 | 0.1 | | | |
| 5 | upper | 1.2 | 0.1 | 25 | 60 | 15 |
| | lower | — | — | | | |
| 6 | upper | 1.2 | 0.2 | 30 | 80 | 15 |
| | lower | — | — | | | |
| 7 | upper | 1.2 | — | 40 | 100 | 10 |
| | lower | 1.2 | — | | | |

As is apparent from Table 1, Sample Nos. 1 and 2 according to the present invention were far less susceptible to pressure marks than Sample Nos. 3, 4, 5 and 6. Sample No. 7, in which protective layers having an increased thickness were provided to impart resistance to pressure marks, reduced gamma, whereas samples of the present invention exhibited only slight reduction in gamma.

EXAMPLE 2

A potassium bromide aqueous solution and a silver nitrate aqueous solution were added simultaneously to a gelatin aqueous solution kept at 50° C. in the presence of ammonium nitrate, sodium hydroxide and tripotassium iridium (III) hexachloride over a period of 60 minutes while maintaining at a pAg of 7.8 to prepare a silver bromide emulsion having a mean grain size of 0.3 μm.

The resulting emulsion was washed with water by the flocculation method, and gelatin was added thereto. Thereafter, 0.2 mol%/mol-silver of potassium iodide aqueous solution was added to the above prepared emulsion to convert the surfaces of grains.

To the emulsion were than added sodium salt of 5,5'-dichloro-9-ethyl-3,3'-bis(3-sulfopropyl)oxacarbocyanine as a sensitizing dye, a dispersion of polyethyl acrylate, polyethylene glycol, 1,3-vinylsulfonyl-2-propanol and $4.5\times10^{-3}$ mol/mol-silver of Compound I-9.

A coating solution for an upper protective layer and a lower protective layer was prepared in the same manner described in Example 1.

The resulting emulsion was coated on a polyethylene terephthalate film to a silver coatage of 3.4 $g/m^2$ simultaneously with an upper protective layer and a lower protective layer having compositions shown in Table 2.

Pressure marks due to scratches were evaluated by the same manner described in Example 1.

TABLE 2

| Sample No. | Protective Layer | Gelatin ($g/m^2$) | Snowtex C ($g/m^2$) | Fog-Causing Load (g) 0.1 mm | 1 mm | Gamma |
|---|---|---|---|---|---|---|
| 21 | upper | 0.3 | 0.15 | 60 | 180 | 15 |
| | lower | 0.9 | — | | | |
| 22 | upper | 0.5 | 0.15 | 55 | 165 | 15 |
| | lower | 0.7 | — | | | |
| 23 | upper | 0.7 | 0.15 | 40 | 145 | 15 |
| | lower | 0.5 | — | | | |
| 24 | upper | 1.2 | 0.15 | 30 | 60 | 15 |
| | lower | — | — | | | |
| 25 | upper | 1.2 | 0.36 | 40 | 100 | 12 |
| | lower | — | — | | | |
| 26 | upper | 1.2 | 0.6 | 60 | 180 | 10 |
| | lower | — | — | | | |
| 27 | upper | 0.6 | — | 20 | 50 | 16 |
| | lower | 0.6 | — | | | |
| 28 | upper | 0.7 | — | 25 | 55 | 14 |
| | lower | 0.7 | — | | | |

As is apparent from Table 2, Sample Nos. 21 through 23 of the present invention exhibited gamma of 15 and were improved in resistance to pressure fog. Sample 27, containing the same amount of gelatin but no colloidal silica, exhibited gamma of 16 but comparatively poor in protective against pressure fog. Sample No. 24, containing the same amount of gelatin and colloidal silica as the samples according to the present invention but having the colloidal silica dispersed throughout a single protective layer, had gamma of 15, but was comparatively poor in protection against pressure fog. Sample Nos. 25 and 26, wherein a greater amount of colloidal silica was incorporated into a single layer protective layer, were improved in resistance to pressure fog, but had gamma of 12 and 10 respectively. Sample No. 28, having an increased amount of gelatin, was only slightly improved in resistance to pressure fog.

While the invention has been described in detail and with reference to specific embodiments thereof, it will be apparent to one skilled in the art that various changes and modifications can be made therein without departing from the spirit and scope thereof.

What is claimed is:

1. A negative silver halide photographic material capable of providing an image having a gamma of 10 or more comprising a support having provided thereon at least one light-sensitive silver halide emulsion layer and further provided on said light-sensitive silver halide emulsion layer at least two light-insensitive hydrophilic colloidal layers, wherein the uppermost layer of said light-insensitive hydrophilic colloidal layers contains colloidal silica having an average particle size of from 7 to 120 mμ in an amount of from about 0.05 to 0.5 $g/m^2$ and said emulsion layer or other hydrophilic colloidal layer contains a hydrazine derivative represented by the formula:

$$R_1—NHNH—CHO$$

wherein $R_1$ represents a substituted or unsubstituted aryl group.

2. A negative silver halide photographic material as in claim 1, wherein said light-insensitive hydrophilic colloidal layers comprise two layers.

3. A negative silver halide photographic material as in claim 1, wherein the colloidal silica has an average particle size of from about 8 to 80 mμ.

4. A negative silver halide photographic material as in claim 1, wherein the colloidal silica contains a stabilizer.

5. A negative silver halide photographic material as in claim 5, wherein the stabilizer is potassium hydroxide or ammonium hydroxide.

6. A negative silver halide photographic material as in claim 1, wherein the colloidal silica is present in an amount of from about 10 to 50% by weight based on the hydrophilic colloid in the uppermost layer.

7. A negative silver halide photographic material as in claim 1, wherein said light-insensitive hydrophilic colloidal layers have a total thickness of from about 0.3 to 5 μm.

8. A negative silver halide photographic material as in claim 9, wherein said light-insensitive hydrophilic colloidal layers have a total thickness of from about 0.5 to 2 μm.

9. A negative silver halide photographic material as in claim 2, wherein the ratio of thickness of said upper light-insensitive layer to that of said lower light-insensitive layer is 1.0 or smaller.

10. A negative silver halide photographic material as in claim 1, wherein said hydrazine derivative is present in said emulsion layer.

11. A negative silver halide photographic material as in claim 1, wherein said hydrazine derivative is present in an amount of from about $10^{-6}$ to $1\times10^{-1}$ mol per mol of said silver halide.

12. A negative silver halide photographic material as in claim 1, wherein the silver halide grain is silver haloiodides having a silver iodide content on the surfaces thereof greater than the average silver iodide content which are produced in the presence of about $10^{-8}$ to $10^{-5}$ mols of an iridium salt or a complex salt thereof per mol of silver.

13. A negative silver halide photographic material as in claim 1, the innermost of said at least two light-insensitive hydrophilic colloidal layers contains no colloidal silica.

* * * * *